US005755589A

United States Patent [19]

Koch

[11] Patent Number: 5,755,589

[45] Date of Patent: May 26, 1998

[54] MULTIPIN CABLE CONNECTOR

[75] Inventor: Joerg Koch, Esslingen, Germany

[73] Assignee: Richard Hirschmann GmbH & Co., Esslingen, Germany

[21] Appl. No.: 450,463

[22] Filed: May 25, 1995

[30] Foreign Application Priority Data

May 25, 1994 [DE] Germany ..... 44 18 259.7

[51] Int. Cl.[6] ..... H01R 4/24

[52] U.S. Cl. ..... 439/427; 439/462

[58] Field of Search ..... 439/427, 320, 439/461, 462, 651, 589, 583–584, 404, 425, 429

[56] References Cited

U.S. PATENT DOCUMENTS

| | | | |
|---|---|---|---|
| 3,703,615 | 11/1972 | Vogt | 200/51.07 |
| 3,951,503 | 4/1976 | Caulkins | 439/427 |
| 4,339,166 | 7/1982 | Dayton | 439/425 |
| 4,441,781 | 4/1984 | Forney, Jr. et al. | 439/584 |
| 4,676,577 | 6/1987 | Szegda | 439/584 |
| 4,758,174 | 7/1988 | Michaels et al. | 439/589 |
| 4,944,686 | 7/1990 | Gertz | 439/175 |
| 4,960,389 | 10/1990 | Frantz et al. | 439/404 |
| 4,969,839 | 11/1990 | Nilsson | 439/395 |
| 5,085,594 | 2/1992 | Kaelin | 439/427 |
| 5,166,477 | 11/1992 | Perin, Jr. et al. | 439/583 |
| 5,203,717 | 4/1993 | Beck et al. | 439/427 |
| 5,295,866 | 3/1994 | Kroger et al. | 439/589 |
| 5,318,458 | 6/1994 | Thörner | 439/427 |
| 5,435,751 | 7/1995 | Papenheim et al. | 439/589 |
| 5,439,388 | 8/1995 | Weiss et al. | 439/462 |
| 5,440,073 | 8/1995 | Lin et al. | 439/584 |

FOREIGN PATENT DOCUMENTS

| | | | |
|---|---|---|---|
| 93 08 457 U | 8/1993 | Germany . | |
| 7900343 | 7/1980 | Netherlands | 439/427 |
| 1 436 592 | 5/1976 | United Kingdom . | |

*Primary Examiner*—Neil Abrams
*Assistant Examiner*—Brian J. Biggi
*Attorney, Agent, or Firm*—Fulbright & Jaworski LLP

[57] ABSTRACT

A multipin cable connector (1) which includes a male connector (16) and a cable seat (10), for connecting a multi-core cord (2) with individual stranded wires (4) by axially contacting the mating-side end sections of the wires (4) with cable-side end areas of contacts (13) located in contact carrier (11) of male connector (16). The end areas are formed especially as contact spikes (20), and are routed and held up to stop (29) in tubular channels (27) of distribution piece (5). One cable-side end part (24) of distribution piece (5) is formed as a clamping area which tapers conically to the free end and has an outline (25) which is matched to the inside contour (26) of mating-side section (18) of tubular grip (6) of cable seat (10), where external wall part (33), which surrounds each channel (27), has at least one longitudinal slot (32). This cable connector (1) is suitable for connection of cords (2) of any configuration and in spite of a simple and cost-efficient structure is characterized by simple installation, permanently reliable electrical and mechanical connection and minimal dimensions, especially in the clamp contact area.

28 Claims, 2 Drawing Sheets

MULTIPIN CABLE CONNECTOR

BACKGROUND OF THE INVENTION

1. Field of Invention

This invention relates to a multipin cable connector. More particularly, this invention relates to a multipin cable connector having a male connector and a cable seat for connecting a multi-core cord having individual stranded wires. One multipin cable connector of this general type is shown in German Utility Model G 93 08 457.

2. Discussion of the Related Technology

Known connectors are characterized by a space-saving clamp connector principle, a recyclable, or detachable and reusable, clamp contact and a simple connection of cables with individual stranded wires which can be assigned to individual plug-in contacts and which are arranged in a certain sequence, where only one stranded wire need be routed to particular stranded wire guide channel of the distribution piece. When the cable is inserted, the assignment of all other individual stranded wires to the corresponding plug-in contacts takes place automatically. However, free assignment, or use of the known connector for stranded cable of any configuration, is not possible.

Moreover, to produce the holding force of the stranded wire necessary for pressing contact spikes into the stranded wire cores, either bends of the stranded wire guide channels or special additional clamping means are necessary, either of which causes considerable additional construction and installation expense as well as an increase in dimensions which do not allow the advantage of space-saving axial contact to be realized at all, or do so only slightly.

Moreover, when bends of the channels in the known connectors are used, it is not always ensured that when a cable gland is installed the mating-side stranded wire ends will be in their desired positions (for example, adjoining the splash walls), or that the holding force will be large enough to guarantee complete axial penetration of the contact spikes. Thus, permanently reliable contact by cold welding is not ensured.

SUMMARY OF THE INVENTION

It is an object of the present invention to devise a cable connector of the type for connecting stranded cables (sometimes referred to as cord) of any configuration, where the means for clamp contacting has the minimum possible dimensions, and the connector can be constructed as simply and cost-efficiently as possible, can be easily handled, and can ensure a permanently reliable contact.

When the cable connector of the present invention is installed, the individual stranded wires routed through the cable seat are introduced into the respective tubular channels of a distribution piece and the latter is inserted into the mating-side section of a tubular connector grip, for which cord of any configuration can be used. In this process, the mating-side ends of the individual stranded wires already adjoin the respective stop on the mating-side end of the channel solely due to the distribution piece being in the desired position and pressed against the wires. As a result of the interaction of conical surfaces of the distribution piece and grip, the outer wall parts, which are made resilient by longitudinal slots, are pressed together and the individual stranded wires are thus wedged in the channels in the desired position such that when the male connector and grip with the introduced distribution piece are then joined, the contact spikes can penetrate completely into the stranded wire cores.

This produces a permanently reliable electrical and mechanical contact.

The angles of incline of the interacting conical surfaces of the distribution piece can be substantially identical. A shorter version, with defined clamping action for a distribution piece adjoining the stop, can be accomplished by allowing the angle of incline relative to the axis at the inner contour of the grip to be greater than that of the lateral surface of the clamping area of the distribution piece. Alternatively, in another embodiment, the inner contour may be cylindrical, or only partially conical.

The clamping means constructed according to the present invention is highly efficient and can be extremely easily adapted to the respective requirements for the clamping force by the corresponding dimensions of the channels and/or the conical surfaces. It is also extremely space-saving, because neither a bend of the channels nor the additional clamping means such as screws, springs, and other fastening means are necessary, so the outside dimensions are determined essentially only by the number, diameter and spacing of the channels. The cable connector is also cost efficient and can be easily installed because of its simple and uncomplicated structure.

In one embodiment, the outer wall parts which surround the channels, and which have a conical outline due to additional slots in intermediate walls in adjacent channels, are relatively elastic. A much lower axial insertion force can be applied to ensure a certain radially effective clamping force. Of course, it is also possible to produce this effect by slots which run in a different pattern, or by additional slots (for example, several slots disposed between the channel and outer wall) or with depressions, or by choosing a correspondingly elastic material for the distribution piece. The channel walls should be strong enough for effective radial clamping of the stranded wire by axially penetrating contact spikes.

By forming the diameter of the tubular channels to be less than the outside diameter of unstripped individual stranded wires, even before actual clamping by the interacting conical surfaces of the distribution piece are plugged into the grip, preliminary fixing of the inserted individual stranded wires is achieved. This ensures that the mating-side faces of the stranded wires are adjoining the stops and thus, in their desired position for radial clamping, even for unintentional minor tensile forces on the cable or on the individual stranded wires or when the distribution piece is unevenly plugged somewhat abruptly into the grip. The smallest channel diameter, resulting in the greatest preliminary fixing force, is achieved when the elasticity value of the slots and/or the material of the distribution piece is optimized so the individual stranded wires can be pushed into the channels without additional measures (for example, bending up). Installation of the connector is facilitated by this embodiment.

Minimizing the channel diameter and thus increasing the preliminary fixing force, and/or achieving easier insertion of the stranded wires into the channels, can be achieved in another embodiment by forming entry cones or channels. The individual stranded wires in the channels are thus effectively prevented from drawing back from the desired position during operation.

In a further embodiment, the angle of incline of the conical outside surfaces of the clamping area of the distribution piece and the angle of incline of the conical inside contour of the mating-side section of the grip is selected so the distribution piece inserted therein is self-locking between the grip and the distribution piece. This eliminates the requirement that the distribution piece be held in the grip by a special means when it is mated to the male connector. Rather, it is held therein by itself until it is fixed after the additional installation step of screwing together the grip and male connector.

In a further embodiment, the lateral surfaces of the clamping area of the distribution piece and the inner surfaces of the mating-side section of the grip, which interact therewith, are conical. Conversely, in a still further embodiment, a multi-surface design is utilized. Thus, the advantage of locking and simple polarization coding can be achieved without additional cost (for example, an irregular polygon in cross-section). This can be of great importance, especially in mechanical plug installation. Moreover, the cable connector can be oriented according to the number of lateral surfaces and the different angular positions on the pertinent stationary mating connectors.

In another embodiment, the grip is used as a handle in the installation of the cable connector to hold and clamp the distribution piece. The grip may also function as a water-tight cable entry fitting, making mechanical/electrical connection with the male connector cost efficient.

To produce the clamp contact, the contact carrier, with the contacts fixed therein, must be pressed against the stranded wires held in the distribution piece. To do this, a union nut is provided to join the male connector and the distribution piece. The nut is screwed onto an outside thread of the distribution piece which presses the distribution piece against the contact carrier and attaches the two parts to one another, allowing for removal. For mechanical production of the mechanical connection of the contact carrier and distribution piece in a still further embodiment, a snap or locking connection is utilized instead of a union nut.

In an additional embodiment, a polarization coding device is provided which ensures the contact carrier and distribution piece can be screwed together only when the mutual assignment of contacts and channels is correct. Cost efficient production and optimum matching between the elasticity of the plastic in a plastic distribution piece and the number and dimensions of the slots ensure that the desired preliminary fixing and clamping action are achieved.

In another embodiment, the distribution piece includes a mating-side connection piece in which channels run axially parallel. This ensures that even for very thin stranded wires, and regardless of the incline of the channels in the clamping area, optimum central-axial contact with the contacts aligned therewith can be achieved.

In two further alternative embodiments, the stop for the individual stranded wires on the mating-side end of the channels of the connection piece of the distribution piece use similar collars. Also, on the mating-side end of the channels, a thin wall is formed which can be penetrated by contact spikes and used as a stop for the individual stranded wires. This ensures all stranded wires, when inserted into the channels of the distribution piece, assume the desired position, where the contact spikes fully penetrate into the stranded wire cores to achieve the maximum radial clamping force and produce a permanently functional contact.

DETAILED DESCRIPTION OF THE PREFERRED EMBODIMENTS

Figure 1:
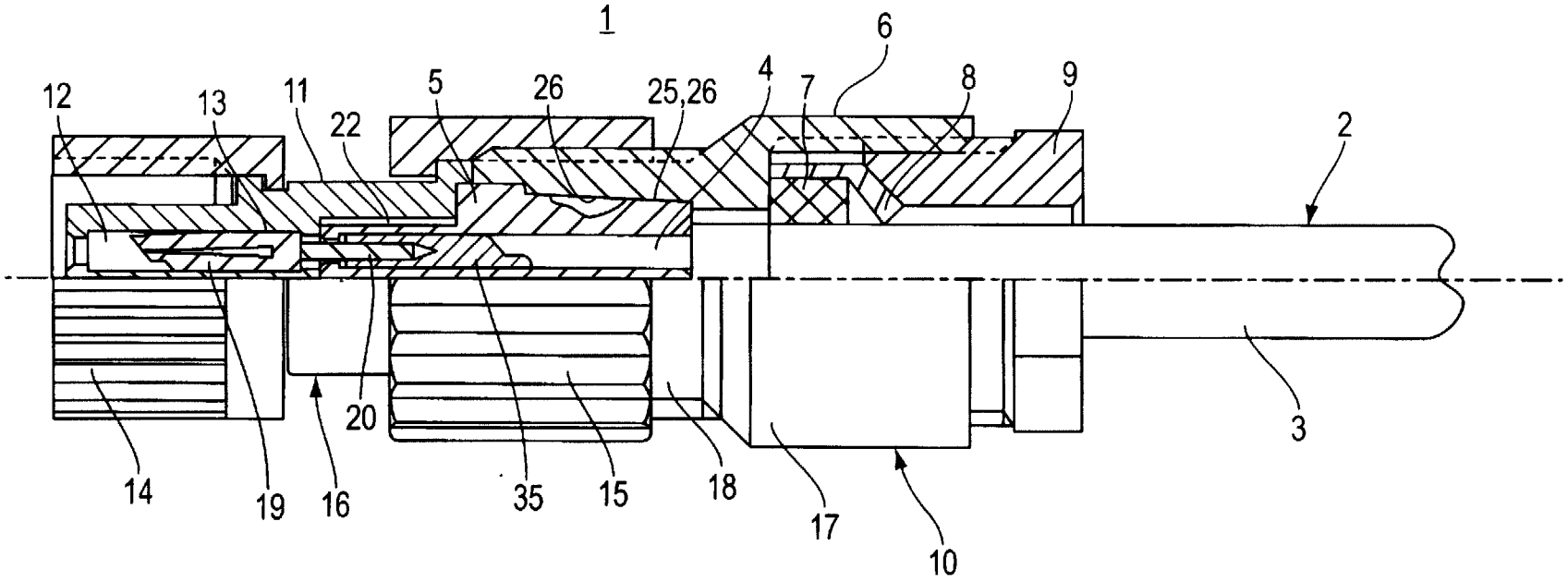
FIG. 1 shows a partially cutaway side view of the cable connector, according to the present invention, having the cord connected.

The multipin cable connector 1 for connecting electrical cord 2 to individual stranded wires 4 jacketed by protective sheath 3, is illustrated in FIG. 1. Preferably, connector 1 includes four pins for connecting to four stranded wires. Multipin connector 1 also includes distribution piece 5 (shown again in FIG. 2) for holding stranded wires 4. Cable seat 10 of connector 1 includes tubular grip 6 and a cable gland which includes gasket 7, spring retainer 8 and pressure screw 9. Male connector 16 of connector 1 includes contact carrier 11, which includes clamping contacts 13 located in contact cavities 12, a first union nut 14 for attachment to a mating connector, not shown, and a second union nut 15 for attachment to distribution piece 5. Male connector 16 and distribution piece 5 can be otherwise joined by use of a snap or screw connection.

Grip 6 on a cable-side section 17 of connector 1 has an inside thread for mating a pressure screw 9, and an outside thread on mating-side section 18 for mating a second union nut 15. Contacts 13 each include a receptacle 19 and a cable-side contact spike 20 which is molded onto receptacle 19 in one piece and has a diameter smaller than that of stranded wire cores 35. Distribution piece 5, shown in FIG. 2, which preferably is made of metal, but may be made of plastic injection molding, is disposed on the mating side of cable seat 10 and includes a connection piece 21 which is pushed into matched depression 22 of contact carrier 11, as shown in FIG. 1, when cable connector 1 is installed. For precise joining of distribution piece 5 and contact carrier 11, a polarization coding depression 23 on connection piece 21 is formed to receive a correspondingly formed coding projection of contact carrier 11 which ensures the plug is correctly installed.

Figure 2:
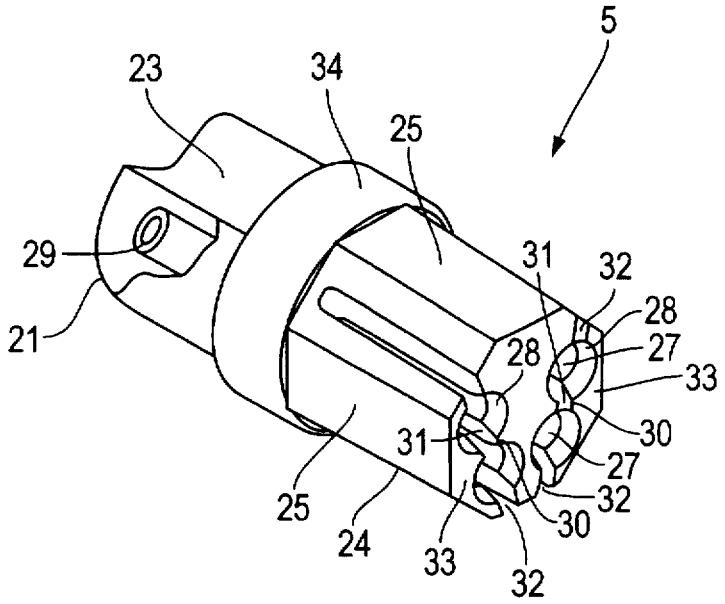
FIG. 2 shows a perspective view of the distribution piece of the cable connector of FIG. 1.

As shown in FIG. 2, cable-sided end part 24 of distribution piece 5 is preferably formed as an octagon having eight flat lateral surfaces 25 tapering conically to the free end. The number of lateral surfaces 25 used may be greater or less than eight in other embodiments. As shown in FIG. 1, inner contour 26 of mating-side section 18 of grip 6 is preferably matched in its shape to the outline of cable-side end part 24 of distribution piece 5. The lateral surfaces 25 of the clamping area, or cable-side end part, 24 of distribution piece 5, and the inner surfaces of the mating-side section of the grip 6, which interact therewith, taper conically. The angle of incline of the conical taper of the inner surfaces is roughly 5°, and that of corresponding lateral surfaces 25 is roughly 1°, relative to the longitudinal axis.

Distribution piece 5, in FIG. 2, is preferably penetrated by four axially-parallel channels 27 each for holding an unstripped stranded wire 4 which align with contacts 13 when the cable connector is installed. The number of channels 27 used in other embodiments may be greater or less than four. The channels 27 begin at entry cones 28 and end at an annular stop collar 29 having an inside diameter less than the diameter of the stranded wires but greater than the diameter of contact spikes 20. Inside intermediate walls 30 of a pair of adjacent channels 27 and the opposite outer walls of the pair of adjacent channels 27, and corresponding lateral surfaces 25 adjacent to said outer walls, have slots 31 and 32 formed therein. These slots, 31 and 32, form resilient outer parts 33 which make cable-side end part 24 act as a clamping area for stranded wires 4 when radial forces are applied. Between the clamping area of cable-sided end part 24 and connection piece 21 is an annular collar 34 having faces which adjoin the corresponding faces of contact carrier 11 and grip 6 when the multipin cable connector 1 is installed.

To form a connector 1, as illustrated in FIG. 1, a cord 2 is routed through cable gland 7, 8, 9, previously described, and grip 6, and is stripped to a length which is somewhat greater than that of distribution piece 5. Then, individual stranded wires 4 are inserted into respective channels 27 until they abut stop collars 29, according to the given connection configuration. The diameter of channels 27 is somewhat less than the outside diameter of the individual stranded wires 4, so entry cones 27 and resilient outer parts 33 easily clamp stranded wires 4 in clamping area 24 of distribution piece 5, so the desired position of the stranded wires is ensured without additional measures and thus, further installation is greatly facilitated. Additionally, distribution piece 5 is pressed into grip 6 by the interaction of conical surfaces 25, 26 which produces a radial force component which provides for the necessary clamping of stranded wires 4 in clamping area 24. Hereupon cable gland 7, 8, 9 is installed in cable-side section 17 of grip 6.

The selected angles of incline of conical surfaces 25, 26 are selected to be small enough to ensure automatic interlock of mated parts, distribution piece 5 and grip 6, for the plastic material used, so no additional means or measures for maintaining this mated state are necessary until subsequent locking by male connector 16 is screwed onto grip 6. However, these angles are chosen to be large enough such that a minimum overall length of mated parts, distribution piece 5 and grip 6, is achieved.

Finally, contact carrier 11 is attached to connection piece 21 of distribution piece 5, so for precise alignment of clamping contacts 13 and stranded wires 4, a polarization coding projection of contact carrier 11, which is not visible, fits into polarization coding depression 23 of connection piece 21. Then, second union nut 15 is screwed onto mating-side section 18 of grip 6. In so doing, contact spikes 20 penetrate axially into the end areas of respective stranded wire cores 35 such that the stranded wires are compressed by radial forces and are pressed under high pressure, together with the stranded wire insulation, against the inner wall of channels 27. This ensures not only a high clamping force, but also a permanently secured electrical and mechanical contact by the stranded wires and contact spikes 20 being cold welded in the process. In spite of the high clamping force acting essentially radially, after unscrewing second union nut 15, the contacts having the contact spikes integral therewith can be easily removed from the stranded wires and the contact cavities. The entire multipin cable connector 1 is thus structured such that all parts can be separated from one another for ease of installation and maintenance.

The cable connector referred to herein is suitable for connecting cords of any configuration, and is characterized entirely by selecting dimensions, especially in the clamp contacting area, that will achieve a simple and cost-efficient structure allowing quick and reliable integral molding of the plug. Adequate clamp contacting and ease of disassembly for recycling purposes is also achieved.

The present invention, therefore, is well adapted to carry out the objects and attain the ends and advantages mentioned herein as well as other ends and advantages made apparent from the disclosure. While preferred embodiments of the invention have been described for the purpose of disclosure, numerous changes and modifications to those embodiments described herein will be readily apparent to those skilled in the art and are encompassed within the spirit of the invention and the scope of the following claims.

What is claimed is:

1. A multipin cable connector of the type used to connect a multi-core cord having individual stranded wires, comprising:

a cable seat disposed on a cable-side end of said cable connector;

a mating-side connector, comprising a contact carrier having a cable-side contact spike having a diameter and extending axially from said contact carrier, said mating-side connector being disposed on a mating-side end of said cable connector opposite said cable-side end; and a distribution piece, having a cable-side end and a mating-side end, and having longitudinal channels formed therein extending substantially between said ends, each said channel having a diameter and being adapted to hold an unstripped individual stranded wire, said distribution piece being disposed between said cable seat and said mating-side connector, and at least one of said channels being in communication with an exterior surface of said cable-side end via a longitudinal slot;

wherein the diameter of said longitudinal channels is greater than the diameter of said contact spike.

2. The cable connector of claim 1, said cable seat further comprising: a tubular grip; and a cable gland comprising a gasket, a spring retainer and a pressure screw.

3. The cable connector of claim 2, said grip having an inside thread for mating a pressure screw.

4. The cable connector of claim 3, said grip having an outside thread on a mating-side section of said grip for mating said second union nut.

5. The cable connector of claim 1, said contact carrier comprising a plurality of clamping contacts, each said contact being disposed within a respective contact cavity formed within said contact carrier.

6. The cable connector of claim 5, said contact carrier further including a first union nut, said nut being adapted to connect to a mating connector.

7. The cable connector of claim 6, said contact carrier further including a second union nut for connecting to said grip.

8. The cable connector of claim 5, said contacts each comprising a receptacle and a cable-side contact spike formed therein and extending axially therefrom.

9. The cable connector of claim 8, wherein each said spike has a diameter less than that of each said unstripped stranded wire.

10. The cable connector of claim 1, said distribution piece having a connection piece formed on said mating-side end of said distribution piece, said connection piece being adapted to be received within a depression formed in said contact carrier.

11. The cable connector of claim 10, said connection piece having a polarization code depression formed therein to receive a correspondingly formed coding projection formed on said contact carrier.

12. The cable connector of claim 1, said cable-side end of said distribution piece having a plurality of lateral surfaces formed thereon which taper to a free end.

13. The cable connector of claim 12, said cable-side end having eight flat lateral surfaces tapering conically to said free end.

14. The cable connector of claim 12, wherein the angle of incline of said taper being approximately five degrees relative to the longitudinal axis.

15. The cable connector of claim 12, each said channel having an inside intermediate wall and an opposite outer wall, wherein at least a portion of each said inside intermediate wall of an adjacent pair of channels, and at least a portion of each said opposite outer wall of said pair of adjacent channels has a longitudinal slot formed therein.

16. The cable connector of claim 15, wherein at least a portion of each said corresponding lateral surface adjacent to said slots formed in said outer walls has a longitudinal slot formed therein.

17. The cable connector of claim 1, said grip having a mating-side section having an inner contour portion formed therein.

18. The cable connector of claim 17, said inner contour portion being formed to substantially match the polygonal outer surface outline of said clamping area formed on said distribution piece.

19. The cable connector of claim 1, said channels being axially-parallel, each said channel having a diameter less than the outside diameter of an unstripped individual stranded wire.

20. The cable connector of claim 1, wherein each said channel begins at an entry cone formed at said first end of said distribution piece, said channels each terminating at an annular stop collar formed within said second end of said distribution piece.

21. The cable connector of claim 20, said annular collar having an inside diameter less than the diameter of said unstripped stranded wires.

22. The cable connector of claim 1, wherein said distribution piece comprises plastic.

23. A method of manufacturing a multipin cable connector, comprising the steps of:

(a) providing a distribution piece having a first end and a second end, wherein a plurality of longitudinal channels are formed in said distribution piece beginning at said first end and terminating at said second end of said piece;

(b) providing a cable seat having a first end adapted to receive a cable, and a second end adapted to receive said first end of said distribution piece; and (c) providing a contact carrier having contact spike extending axially therefrom, said contact spike adapted to penetrate one of said longitudinal channels.

24. The method of claim 23, wherein said step of attaching said contact carrier is accomplished by attaching said contact carrier to a connection piece formed in said second end of said distribution piece.

25. The method of claim 23, further comprising the step of:

providing a polarization coding projection on said contact carrier and providing a corresponding polarization coding depression in said second end of said distribution piece.

26. The method of claim 25, further comprising the step of:

screwing a union nut onto said mating-side end portion of said grip.

27. The method of claim 26, wherein said step of screwing a nut is accomplished by axially penetrating contact spikes, said spikes formed within and projecting from said clamping contacts, into end areas of respective cores of said stranded wires, wherein said stranded wires are compressed against inner walls of said longitudinal channels.

28. The method of claim 23, further comprising providing said distribution piece with a conically tapered clamping area, and providing said cable seat with an inside contour substantially matching the outer surface contour of said distribution piece conically tapered clamping area.

* * * * *